US007121872B1

(12) United States Patent
Hanks

(10) Patent No.: US 7,121,872 B1
(45) Date of Patent: Oct. 17, 2006

(54) ELECTRICAL CONNECTOR WITH INTERFERENCE COLLAR

(75) Inventor: Rip Hanks, Gulf Breeze, FL (US)

(73) Assignee: Centerpin Technology Inc., Pensacola, FL (US)

( * ) Notice: Subject to any disclaimer, the term of this patent is extended or adjusted under 35 U.S.C. 154(b) by 0 days.

(21) Appl. No.: 11/140,698

(22) Filed: May 31, 2005

(51) Int. Cl.
*H01R 4/24* (2006.01)

(52) U.S. Cl. ..... 439/427; 439/805

(58) Field of Classification Search ..... 439/411–414, 439/417–419, 425–428, 801, 784, 805, 807; 174/65 SS
See application file for complete search history.

(56) References Cited

U.S. PATENT DOCUMENTS

| | | | | |
|---|---|---|---|---|
| 916,313 | A | 3/1909 | Herrington | |
| 1,247,656 | A | 11/1917 | Gadke | |
| 1,856,018 | A | 4/1932 | Barth | |
| 2,839,595 | A | 6/1958 | Felts et al. | |
| 3,683,320 | A | 8/1972 | Woods et al. | |
| 3,708,781 | A | 1/1973 | Trompeter | |
| 3,744,007 | A | 7/1973 | Horak | |
| 3,792,419 | A | 2/1974 | Spinner | |
| 3,796,504 | A | 3/1974 | Marechal | |
| 3,860,320 | A | 1/1975 | Danner | |
| 3,977,752 | A | 8/1976 | Freitag | |
| 4,270,827 | A | 6/1981 | Potgieter | |
| 4,352,240 | A | 10/1982 | Komada | |
| 4,374,458 | A | 2/1983 | Komada | |
| 4,408,822 | A | 10/1983 | Nikitas | |
| 4,739,126 | A | 4/1988 | Gutter et al. | |
| 4,789,355 | A | 12/1988 | Lee | |
| 4,944,686 | A | 7/1990 | Gertz | |
| 5,066,248 | A | 11/1991 | Gaver, Jr. et al. | |
| 5,181,861 | A | 1/1993 | Gaver, Jr. et al. | |
| 5,221,213 | A | 6/1993 | Lee | |
| 5,318,458 | A | 6/1994 | Thorner | |
| 5,362,251 | A | 11/1994 | Bielak | |
| 5,410,104 | A * | 4/1995 | Gretz et al. | 174/65 SS |
| 5,503,568 | A | 4/1996 | Pryce | |
| 5,564,942 | A | 10/1996 | Lee | |
| 5,573,423 | A | 11/1996 | Lin et al. | |
| 5,573,433 | A | 11/1996 | Lin et al. | |
| 5,607,320 | A | 3/1997 | Wright | |
| 5,695,369 | A | 12/1997 | Swenson | |
| 5,704,814 | A | 1/1998 | McCarthy | |
| 5,899,777 | A | 5/1999 | Liang | |
| 5,934,937 | A | 8/1999 | McCarthy | |
| 5,934,943 | A | 8/1999 | McCarthy | |
| RE36,700 | E | 5/2000 | McCarthy | |
| 6,071,155 | A | 6/2000 | Liang | |
| 6,126,491 | A | 10/2000 | McCarthy | |
| 6,168,455 | B1 | 1/2001 | Hussaini | |
| 6,244,892 | B1 | 6/2001 | McCarthy | |

(Continued)

FOREIGN PATENT DOCUMENTS

| | | | |
|---|---|---|---|
| DE | 1620307 | U | 2/1951 |

(Continued)

*Primary Examiner*—James R. Harvey
(74) *Attorney, Agent, or Firm*—Jefferson Perkins

(57) ABSTRACT

In an electrical connector suitable for a multistranded insulated conductor, a frustoconical collar is so dimensioned that it will exhibit physical interference with a housing bore into which the conductor and the collar are inserted. As the collar is advanced into the bore, fingers of the collar more tightly grip the external surface of the conductor. A cap affixes the conductor and collar to the housing to complete the connection.

24 Claims, 3 Drawing Sheets

U.S. PATENT DOCUMENTS

| | | | | |
|---|---|---|---|---|
| 6,705,884 | B1 | 3/2004 | McCarthy | |
| 6,773,295 | B1 * | 8/2004 | Lindemann et al. | 439/428 |
| 6,796,829 | B1 | 9/2004 | McCarthy | |
| 6,851,966 | B1 * | 2/2005 | Tomasino | 439/411 |
| 2002/0127911 | A1 | 9/2002 | Di Mario | |

FOREIGN PATENT DOCUMENTS

| | | | |
|---|---|---|---|
| DE | 1921200 | A1 | 11/1970 |
| DE | 2348882 | A1 | 4/1975 |
| EP | 0683545 | A1 | 11/1995 |
| GB | 1109914 | | 4/1968 |
| GB | 2300765 | A | 11/1996 |
| WO | WO 85 04052 | A1 | 9/1985 |
| WO | WO 97/34340 | A1 | 9/1997 |
| WO | WO 03/009424 | A1 | 1/2003 |

* cited by examiner

ELECTRICAL CONNECTOR WITH INTERFERENCE COLLAR

BACKGROUND OF THE INVENTION

Electrical connectors are known in the art which are meant to terminate multistranded insulated conductors, such as those used to transmit electrical power (e.g. battery cables) or communication signals (e.g. speaker wires). Persons skilled in this art, when designing such connectors, have several objectives or design criteria, some of which can come into conflict with others. These objectives include (a) ease of manufacture, (b) cost of manufacture, (c) tightness and permanence of connection, and (d) ease of assembly by the user.

The assignee of the present invention has provided several types of such electrical connectors. One type of connector employs a collar which grips the conductor, where the conductor is threaded through the collar and a cap. The collar and conductor are secured in place to a connector housing by the cap. Representative of this type of connector are the ones illustrated and described in U.S. Pat. Nos. 5,704,814, 5,934,943 and 5,934,937, and U.S. patent application Ser. No. 09/330,381 filed Jun. 11, 1999, all assigned to the assignee hereof, the specifications of which being fully incorporated by reference herein. Nonetheless, further improvements can be made in producing an electrical connector that better meet the above design criteria.

SUMMARY OF THE INVENTION

An electrical connector according to the invention has a housing with a bore. A collar is provided with first and second axial ends and a sloped surface extending between them. The external diameter of the collar at its first end is smaller at than an interior diameter of the bore opening, while the external diameter of the collar at its second end is larger than the bore opening interior diameter. An interior diameter of the collar is sized to receive an end of an elongated conductor to which the connector is to be coupled. Means, such as a cap, are provided for affixing the collar and the conductor in the bore of the housing. Preferably this cap is affixable to an external surface of the housing by means such as threads, snap rings or a bayonet (push and turn) connection. As the collar is urged into the housing bore, the collar clamps on the external surface of the conductor.

In an alternative embodiment of the present invention, the electrical connector has a housing with a bore and a collar. At least one sidewall defining the bore has a surface which is parallel to the bore axis. The collar has an external diameter at its first end which is smaller than the internal diameter and a sloped surface which extends from the first end to a second end. An interior diameter of the collar is sized to receive the end of an elongated conductor therethrough. A means such as a cap is provided to affix the collar and the conductor in the bore of the housing. As the collar is urged into the housing bore, the sloped surface interacts with the housing bore sidewall to axially inwardly compress the collar onto the conductor, thereby affixing the conductor to the housing.

In one version of either of the above embodiments, the housing bore has a bottom and a conductive prong which extends toward the bore opening. This prong is provided to pierce the end of a multistranded conductor. Preferably, the housing has a second axial end opposed to the bore end, at least a central portion of the second end being in conductive communication with the prong. This second end can take the form of a pin connector, a banana plug, a spade, a battery terminal or a second bore for receiving a second elongated conductor, which may be of a different size than the first conductor.

While the housing, cap and collar can be made entirely of metal, it is preferred to make the cap and collar out of insulative material, and a peripheral portion of the housing as well. Preferably this insulative material is a molded plastic, by which the connector may be produced more easily and at less cost.

The electrical connectors of the present invention are easy to manufacture yet provide secure electrical connections to conductors, particularly insulated multistranded conductors. A firm connection is made by coacting a frustoconical or frustopyramidal collar, on the one hand, with a cylinder or prismatic bore, on the other. Cylindrical bores are easier to machine than, for example, ones with conical or sloping surfaces. Likewise, forming many of the components of molded plastic saves manufacturing expense.

BRIEF DESCRIPTION OF THE DRAWINGS

Further aspects of the invention and their advantages can be discerned in the following detailed description, in which like characters denote like parts and in which.

DETAILED DESCRIPTION

Figure 1:
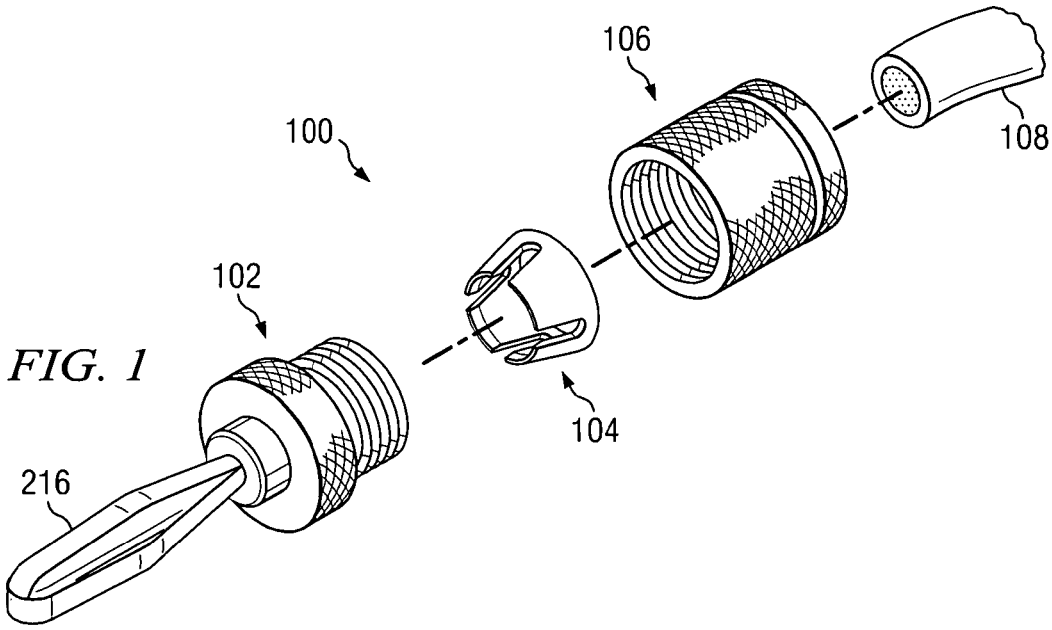
FIG. 1 is an isometric exploded view of one embodiment of an electrical connector according to the invention, and a conductor which the connector is adapted to terminate.

Referring first to FIG. 1, the present invention provides an electrical connector 100 which has, as its principal components, a housing 102, a collar 104 and a cap 106. The connector 100 is particularly useful in connecting a multistranded insulated conductor 108, of the type which is prevalent in the transmission of power (such as battery cables) and communications signals (such as speaker wires), although the invention can be used to connect to conductors of other types. As will be described in more detail below, the cap 106 and collar 104 are threaded onto the conductor 108, the conductor 108 is inserted into a bore of the housing 102 preferably to be impaled on a prong disposed therein, the collar 104 is wedged into the bore opening to clamp the conductor 108 in place, and the cap is attached as by threading to the collar 102 to hold the collar 104 and conductor 108 in place.

Figure 2:
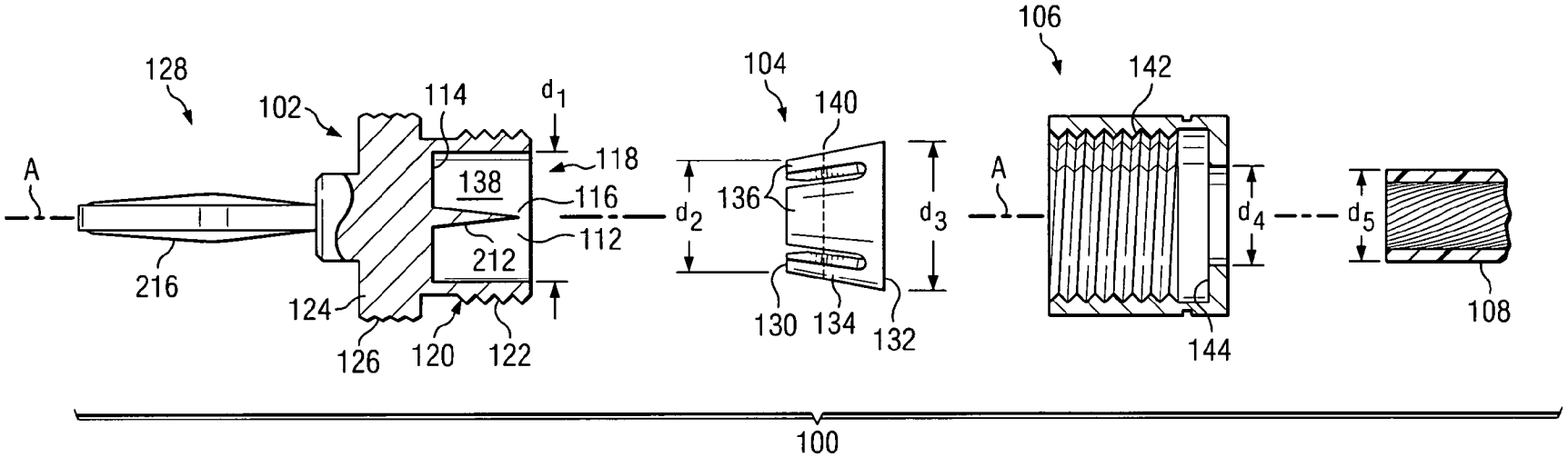
FIG. 2 is a part-elevational, part-sectional exploded view of the connector shown in FIG. 1.

As seen in FIG. 2, the housing 102 has a preferably cylindrical bore 112 that is disposed around an axis A. The bore 112 has a bottom 114, the center from which extends a conductive prong 212 toward the bore opening. It is preferred that the prong be pointed and that it be sloped from its point of attachment to bottom 114 to its point 116. It is also preferred that the prong 212 be somewhat shorter than the depth of the bore 112.

The bore 112 can take shapes other than the orthogonal cylinder shown; it can, for example, take on a prismatic shape. It is preferred that the sidewalls 138 of the bore be completely formed by one or more surfaces which are parallel to the bore axis, such that the cross section of the bore is the same at the opening as it is at its bottom. For ease in manufacture, and particularly where the housing 102 is made of steel, brass or another metal (as is the embodiment shown in FIG. 2), a straight cylinder with smooth internal sidewalls 138 is particularly preferred. The bore 112 has an internal diameter $d_1$ along its length and at its open end 118. No initial bevel at the entrance of bore 112 is required, saving an additional manufacturing step.

That portion 120 of the housing 102 which includes the bore 112 has, in this embodiment, external threads 122. In other embodiments, the threads 122 can be replaced with other means of affixing the cap 106 to the external surface of the housing 102, such as snap rings and grooves (see FIG. 13) or a bayonet-style connection, in which upstanding processes on the outside surface of housing 102 fit into grooves formed in the cap 106, and wherein these grooves have first portions in axial alignment and second portions formed at a ninety degree angle to the axis.

End portion 120 of the housing 102 adjoins a central portion 124, which in the illustrated embodiment has an enlarged diameter and which is knurled on its outer surface 126. The diameter enlargement and the knurled surface adapt this housing 102 to be manually assembled to cap 106 without tools. As the diameter of central portion increases, the moment arm from its surface to the axis A likewise increases, allowing a human hand which grasps it to resist more torque than would otherwise be the case. Alternatively, the outer surface 126 can have one or more pairs of wrench-engaging surfaces (such as a hex shape) for assembly by a tool.

Figure 4:
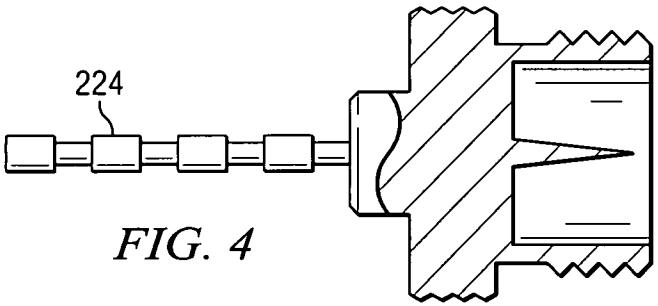
FIG. 4 is a partial sectional elevational view showing a housing according to a second embodiment of the invention.

On the other axial end of central portion 124 is a connector element portion 128. In the embodiment shown in FIG. 2, this connector element portion includes a "banana plug" 216 as a connector element, meant to be received into a bore of an electronic device and having a series of spring leaves. Other connector elements are possible, and one such, a pin connector 224, is shown in FIG. 4. Other possible connector elements include spades and battery terminals.

In the embodiment shown in FIG. 2, the entirety of the housing 102 is made of metal and is coated with a conductive and environmentally impervious coating, such as gold plate. As will be described below, however, a large portion of the housing 102 can instead be made of plastic or another material.

The collar 104 as shown in FIG. 2 takes a general frustoconical shape, although the external shape of collar 104 could be frustopyramidal, particularly where the sidewalls 138 forming the bore 112 take the shape in cross section of a polygon rather than a circle, in which case a radial section of the frustopyramid would match the shape of that polygon. A first, smaller end 130 has an exterior diameter $d_2$ which is smaller than the bore opening diameter $d_1$. A second, larger end 132 has an exterior diameter $d_3$ which is larger than the bore opening diameter $d_1$. Hence, when the collar 104 is inserted into the bore 112, there will be an interference between the sidewall 134 of the collar 104 and the sidewall 138 of bore 112 at its opening 118. The interference caused by contacting these two surfaces will cause an inward force to be exerted on the collar 104 as the collar 104 is urged into the bore 112, tending to compress the sidewall 134 inward toward the axis A and thereby causing the collar 104 to clamp to the external diameter of the conductor 108.

Preferably, the collar 104 is segmented into a plurality (here, four) fingers or leaves 136. The large end 132 is unsegmented, while the small end 130 is segmented. This aids in the compressibility of the small end 130 around conductor 108 as it is urged inwardly by the sidewall 138 of bore 112. While the collar 104 can be manufactured of any of a number of resilient materials such as steel or other metal, it is preferred that collar 104 be molded of plastic.

In the illustrated embodiment, the collar 104 (and the conductor then within it) are affixed to the housing 102 by a cap 106. The cap 106 has a general interior surface 142 with a diameter larger than that of collar diameter $d_3$. The larger end 132 of the collar 104 is adapted to be seated against the bottom or end wall 144 of the cap 106. In the middle of end wall 144 is an opening 146 having a diameter $d_4$ which is substantially smaller than that of collar exterior diameter $d_3$, but the same as or larger than an external diameter $d_5$ of the conductor 108. In the embodiment illustrated in FIG. 2, cap 106 is of metal and has been machined, but can be made of other materials (as will be described below).

The function of cap 106 is to affix conductor 108 and collar 104 to the housing 102. In the illustrated embodiment, this is done by sizing cap 106 so that it will fit over end portion 120 of housing 102, and by providing threads on the internal cylindrical surface 142. These female threads threadedly engage with male threads 122 on housing end portion 120. The internal threads may be replaced in other embodiments with snap grooves (see FIG. 6) or with grooves adapted to make a "bayonet" style connection, in which the cap is first moved axially toward the housing 102, and then twisted to lock it in place.

Figure 3:
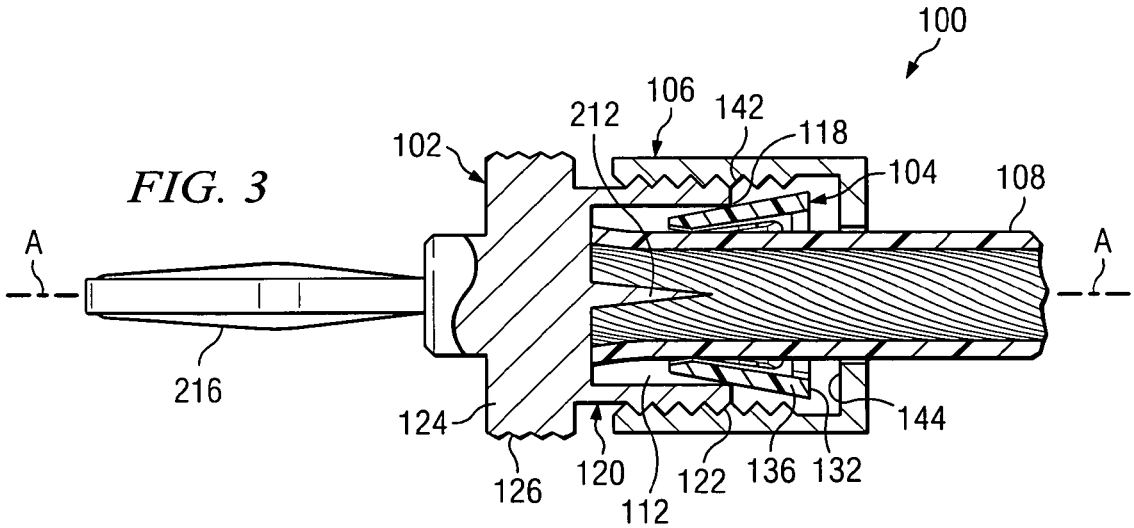
FIG. 3 is an axial sectional view of the connector shown in FIGS. 1 and 2, as assembled to the conductor.

FIG. 3 shows the connector 100 as it has been assembled to the end of the conductor 108, which in the illustrated embodiment is a multistranded insulated conductor. In operation, an end of the conductor is cut substantially orthogonal to its axis. The conductor 108 is then inserted through the cap 106 and then the collar 104. The conductor end is then inserted into bore 112 and its end is impaled on conductive prong 212. The collar 104 is then slid home against bore opening 118. Next, the cap 106 is threaded onto male threads 122 of the housing section 120. As the cap is advanced toward the prong 212, the cap end wall 144 applies force to the larger axial end 132 of the collar 104, in turn urging collar 104 inward. The interaction of collar sidewall 134 with the bore opening 118 forces the fingers 136 radially inwardly toward axis A, which in turn grip the external surface of conductor 108, holding it in place and providing strain relief.

Figure 5:
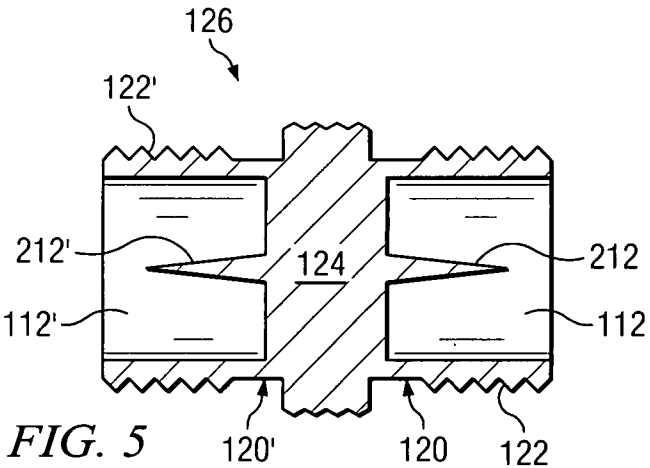
FIG. 5 is an axial sectional view showing a double-bore housing according to a third embodiment of the invention.

FIG. 5 shows an embodiment of the invention meant to connect two conductors together end-to-end. Instead of a banana plug 216 or a pin connector 224 (FIG. 4), the conductor-receiving portion 120 is essentially mirror-imaged on the other side of central portion 124. There is therefore a second bore 112', a second threaded surface 122' and a second conductive prong 122'. While the portions 120, 120' are illustrated to be identical to each other, this need not necessarily be the case. In fact, one use of the invention is to connect two conductors of substantially different size end-to-end, in which case the bore 112' could be different in diameter than bore 112, and accept a collar and cap of similarly differing size.

Figure 6:
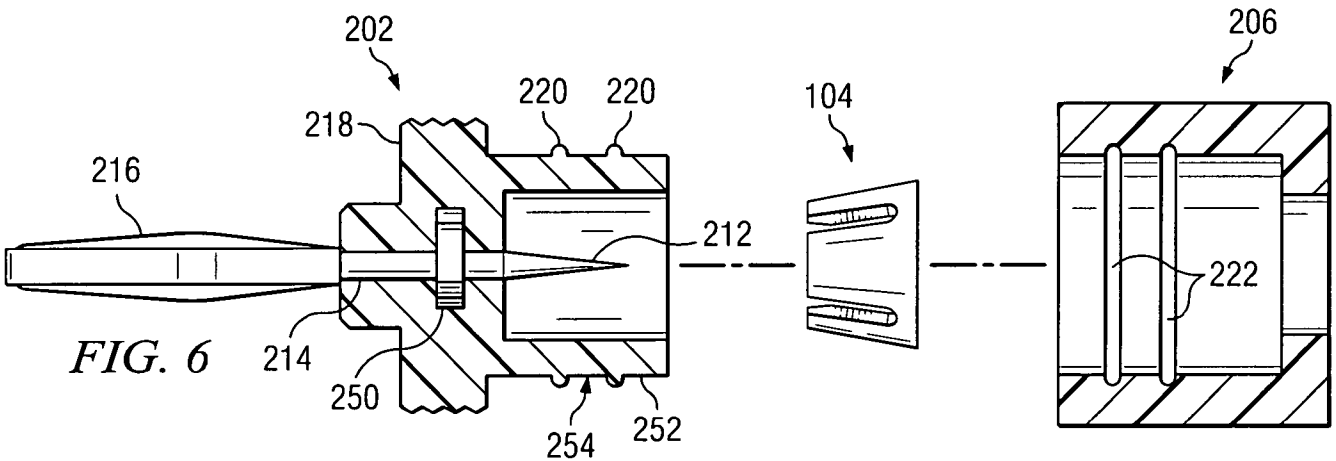
FIG. 6 is an exploded axial part-sectional view showing a housing, collar and cap according to a fourth embodiment of the invention.

FIG. 6 shows an alternative embodiment of a housing 202 and a cap 206 which uses much more plastic, and much less metal, in their construction. This reduces manufacturing cost and avoids certain expensive machining and welding steps. The housing 202 retains a central shaft or element 214 that terminates in prong 212 in one direction and a connector element (such as banana plug 216) in the other. These structures are in conductive communication with each other. But the rest of housing 202, peripheral to the central portion 214, can be made up by a molded plastic portion 218, as there is no requirement for it to be conductive. The plastic portion would be molded around non-radially symmetrical processes 250 on shaft 214 to prevent angular and axial displacement of the plastic portion 218 relative to the metal component 214. To compensate for their typically weaker properties, the sidewalls 252 of the conductor-connecting portion 254 are made thicker, particularly at that point contacted by collar loci 140, 140'.

The cap 206 can be made entirely of plastic, as shown. Cap 206 fits over portion 254 of the housing 202. In place of threads, the embodiment shown in FIG. 6 has annular, radially outwardly projecting snap-rings 220 on the housing portion 252, and mating annular grooves 222 on the interior surface of cap 206. Either embodiment shown in FIGS. 2 and 6 could use a threaded connection, a ring-and-groove connection, a bayonet connection or other method of affixing the cap to the housing, and the illustrated exemplary methods of affixing the cap to the housing should not be considered limiting. The purpose of cap 206 is to affix the collar and conductor to housing 202, similar to the embodiment shown in FIG. 2.

In summary, embodiments of a novel electrical connector have been shown and described in which a collar is so dimensioned that it has an interference engagement with a housing bore, squeezing the collar inward as it is urged axially into the bore, to thereby firmly grip the conductor to which connection is made. The present invention offers economies in manufacture in that the housing does not have to be made with conical or other noncylindrical bore surfaces, and in that much of the connector does not have to be machined from metal. At the same time, the connector of the invention offers a firm and permanent connection to the conductor which it terminates, which connection can easily be effected by the end-user without tools.

While an illustrated embodiment of the present invention has been described and illustrated in the appended drawings, the present invention is not limited thereto but only by the scope and spirit of the appended claims.

I claim:

1. An electrical connector for coupling to an elongated multi-stranded conductor, comprising:

a housing having a first end, a second end and a bore formed around an axis of the housing and being open at the first end, an opening of the bore at the first end having a first interior diameter, the bore having a bottom, the housing having an external surface adjacent the first end;

a conductive axial prong extending from the bottom of the bore toward the first end of the housing and adapted to pierce an end of the multistranded conductor to make electrical connection thereto;

an axial portion of the housing extending from the prong to the second end being conductive, a second portion of the housing disposed radially outwardly from the axial portion being formed of insulative material;

a collar formed around the axis and having first and second opposed axial ends, a sloped surface extending between the first and second ends, an exterior diameter of the collar at the first end being smaller than the first interior diameter of the bore, an exterior diameter of the collar at the second end being larger than the first interior diameter of the bore, an interior diameter of the collar at the first end thereof being sized to receive the conductor therethrough; and means for affixing the collar and the conductor in the bore of the housing.

2. The connector of claim 1, wherein the means for affixing comprises a cap formed around the axis and having opposed first and second axial ends, an opening at the first end of the cap having a diameter larger than the exterior diameter of the collar at the collar's second end, an opening at the second end of the cap having a diameter smaller than the exterior diameter of the collar's second end, the opening at the second end of the cap sized to receive the conductor therethrough; and means for axially affixing the cap to the external surface of the housing.

3. The connector of claim 2, wherein the means for affixing is selected from the group consisting of threads, snap rings and bayonet connections.

4. The electrical connector of claim 2, wherein the cap is formed of an insulator.

5. The electrical connector of claim 1, wherein the collar is formed of an insulator.

6. The electrical connector of claim 1, wherein the second end is selected from the group consisting of a battery terminal, a spade, a pin connector and a banana plug.

7. The electrical connector of claim 1, wherein the second end includes a second bore for receiving a second elongate conductor.

8. The electrical connector of claim 1, wherein the bore of the housing is defined by at least one sidewall formed of insulative material.

9. The electrical connector of claim 1, wherein the insulative material is molded plastic.

10. The electrical connector of claim 1, wherein the bore of the housing is defined by at least one sidewall having a surface parallel to the axis.

11. The electrical connector of claim 10, wherein said at least one sidewall is cylindrical.

12. An electrical connector for coupling to an elongated conductor, comprising:

a housing having a first end and a bore formed around an axis of the housing and being open at the first end, an opening of the bore at the first end having a first interior diameter, the housing having an external surface adjacent the first end, the bore defined by at least one sidewall disposed to be parallel to the axis;

a collar formed around the axis and having first and second opposed axial ends, a sloped surface extending between the first and second ends, an exterior diameter of the collar at the first end thereof being smaller than the first interior diameter of the bore, an exterior diameter of the collar at the second end thereof being larger than the first interior diameter of the bore, an interior diameter of the collar at the first end thereof being sized to receive the conductor therethrough; and means for affixing the collar and the conductor in the bore of the housing.

13. The electrical connector of claim 12, wherein the bore is cylindrical.

14. The connector of claim 12, wherein the means for affixing comprises a cap formed around the axis and having opposed first and second axial ends, an opening at the first end of the cap having a diameter larger than the exterior diameter of the collar at the collar's second axial end, an opening at the second end of the cap having a diameter smaller than the exterior diameter of the collar's second end, the opening at the second end of the cap sized to receive the conductor therethrough; and means for axially affixing the cap to the external surface of the housing.

15. The connector of claim 14, wherein said means for affixing is selected from the group consisting of threads, snap rings and bayonet connections.

16. The connector of claim 14, wherein the cap is formed of molded plastic.

17. The connector of claim 12, wherein the collar is formed of molded plastic.

18. The connector of claim 12, wherein the conductor is a multistranded conductor and wherein the bore of the housing has a bottom, a conductive axial prong extending from the bottom of the bore toward the first end thereof and adapted to pierce an end of the multistranded conductor to make electrical connection thereto.

19. The connector of claim 18, wherein the housing has a second axial end opposed to the first end, at least a central portion of the second end of the housing being in conductive communication with the prong.

20. The connector of claim 19, wherein the second end is selected from the group consisting of a battery terminal, a spade, a pin connector and a banana plug.

21. The connector of claim 19, wherein the second end includes a second bore for receiving an end of a second elongate conductor.

22. The connector of claim 19, wherein an axial portion of the housing extending from the prong to the second end of the housing is conductive, a second portion of the housing disposed radially outwardly from the axis being formed of molded plastic.

23. The connector of claim 22, wherein said at least one sidewall of the bore of the housing is formed of molded plastic.

24. The connector of claim 12, wherein the opening of the bore at the first end thereof is not beveled.

* * * * *